US007866672B2

(12) United States Patent
Brunner

(10) Patent No.: US 7,866,672 B2
(45) Date of Patent: Jan. 11, 2011

(54) SKATE PROPULSION MECHANISMS

(76) Inventor: Adolf Brunner, Ennsweg 35, A-5550 Radstadt (AT)

( * ) Notice: Subject to any disclaimer, the term of this patent is extended or adjusted under 35 U.S.C. 154(b) by 354 days.

(21) Appl. No.: 11/804,088

(22) Filed: May 17, 2007

(65) Prior Publication Data

US 2007/0273110 A1 Nov. 29, 2007

(30) Foreign Application Priority Data

May 17, 2006 (EP) ..... 06010148

(51) Int. Cl.
*A63C 17/12* (2006.01)

(52) U.S. Cl. ..... 280/11.115

(58) Field of Classification Search ..... 280/11.115, 280/11.19, 11.201, 11.221, 11.224, 11.231; 192/38, 44, 45, 50; 74/125.5
See application file for complete search history.

(56) References Cited

U.S. PATENT DOCUMENTS

| | | | | | |
|---|---|---|---|---|---|
| 684,260 | A * | 10/1901 | Jassmann | 280/11.115 |
| 903,525 | A * | 11/1908 | Wellnitz | 280/11.115 |
| 936,173 | A * | 10/1909 | Schoenberg | 280/11.115 |
| 1,003,135 | A * | 9/1911 | Gauntt | 192/50 |
| 1,164,798 | A * | 12/1915 | Felley | 280/11.115 |
| 1,338,813 | A * | 5/1920 | Chiarelli | 280/11.115 |
| 1,437,314 | A * | 11/1922 | Jorgensen | 280/11.115 |
| 1,587,749 | A * | 6/1926 | Bierly | 482/80 |
| 1,628,004 | A * | 5/1927 | Stetson | 280/11.115 |
| 1,761,807 | A * | 6/1930 | Van Etten | 280/11.115 |
| 1,782,078 | A * | 11/1930 | Stiver | 280/11.115 |
| 1,784,761 | A * | 12/1930 | Smith | 280/11.115 |
| 1,924,948 | A * | 8/1933 | Lieberenz | 280/11.115 |
| 1,955,698 | A * | 4/1934 | Bushong | 192/48.3 |
| 2,061,334 | A * | 11/1936 | Stone | 280/11.115 |
| 2,068,773 | A * | 1/1937 | Slider | 192/45 |
| 2,174,990 | A * | 10/1939 | Maguire | 280/11.115 |
| 2,449,871 | A * | 9/1948 | Bohler | 280/11.115 |
| 4,417,737 | A * | 11/1983 | Suroff | 280/11.115 |
| 5,286,239 | A * | 2/1994 | Ito et al. | 475/231 |
| 5,621,984 | A * | 4/1997 | Hsieh | 36/28 |
| 6,065,763 | A * | 5/2000 | Adams, Jr. | 280/11.28 |
| 6,237,923 | B1 * | 5/2001 | Fowle | 280/11.115 |
| 2003/0047893 | A1 * | 3/2003 | Pahis | 280/11.115 |

FOREIGN PATENT DOCUMENTS

| | | |
|---|---|---|
| DE | 3436836 A1 | 10/1984 |
| DE | 3942210 A1 | 12/1989 |
| FR | 573934 | 7/1924 |
| GB | 1062467 | 3/1967 |

OTHER PUBLICATIONS

European Search Report for Priority Application EP 06010148.

* cited by examiner

*Primary Examiner*—J. Allen Shriver, II
*Assistant Examiner*—Vaughn T Coolman
(74) *Attorney, Agent, or Firm*—Byrne Poh LLP

(57) ABSTRACT

Skate propulsion mechanisms are provided. In some embodiments, skate propulsion mechanisms comprise: a base plate; a drive wheel couple to the base plate; a shoe plate to which a user's foot can be coupled, which shoe plate can be moved relative to the base plate in response to movements in the user's foot; and a drive mechanism, coupling the shoe plate, the base plate, and the drive wheel, that propels the drive wheel when the user's foot is moved in a first direction and that permits the drivel wheel to operate in a free wheel mode when the user's foot is stationary.

13 Claims, 2 Drawing Sheets

SKATE PROPULSION MECHANISMS

CROSS REFERENCE TO RELATED APPLICATION

This application claims the priority under 35 U.S.C. §119 to European Patent Application No. EP06010148, filed May 17, 2006, which is hereby incorporated by reference herein in its entirety.

TECHNICAL FIELD

The disclosed subject matter relates to skate propulsion mechanisms.

BACKGROUND

Rolling skates are widely popular, and are frequently found in the form of roller skates and in-line skates. When using existing skates, a user is propelled forward by the user applying a lateral, forward-facing force against the wheels of alternating ones of the skates. This lateral force moves the user forward.

In order to apply this lateral force, the user must twist his or her leg outward and push outward and backward. This pushing creates strain on the user's knees which can cause injury or pain.

SUMMARY

Skate propulsion mechanisms are provided. In some embodiments, skate propulsion mechanisms comprise: a base plate; a drive wheel couple to the base plate; a shoe plate to which a user's foot can be coupled, which shoe plate can be moved relative to the base plate in response to movements in the user's foot; and a drive mechanism, coupling the shoe plate, the base plate, and the drive wheel, that propels the drive wheel when the user's foot is moved in a first direction and that permits the drivel wheel to operate in a free wheel mode when the user's foot is stationary.

DETAILED DESCRIPTION

Figure 1:
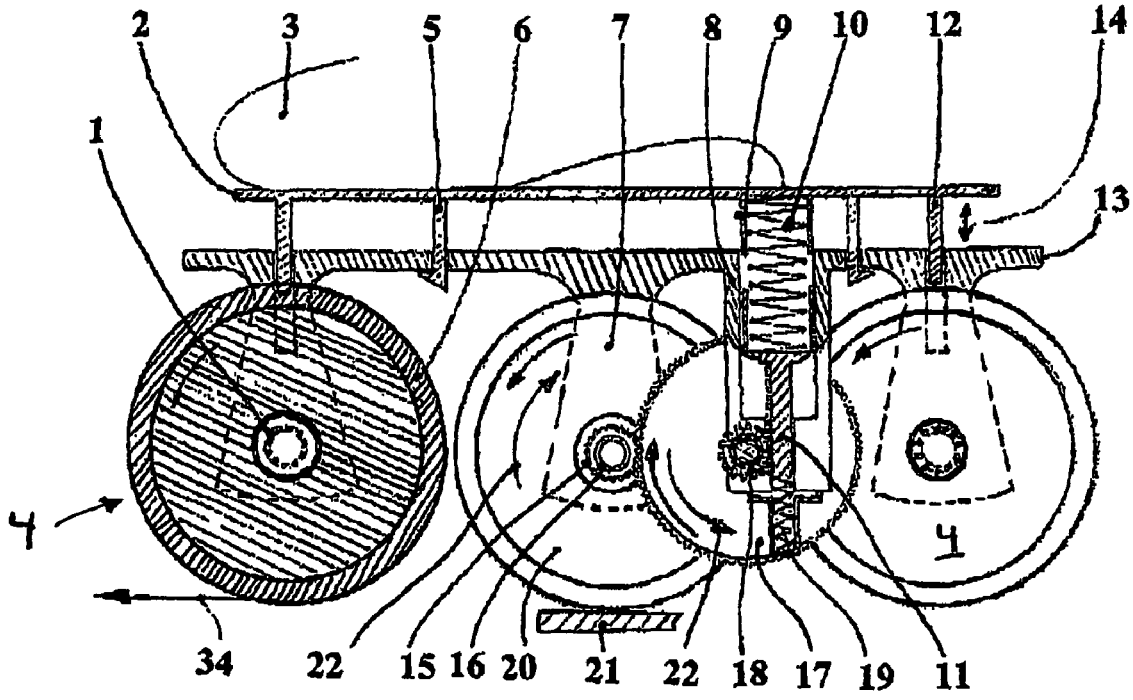
FIG. 1 is a diagram of a skate in accordance with some embodiments.
Figure 2:
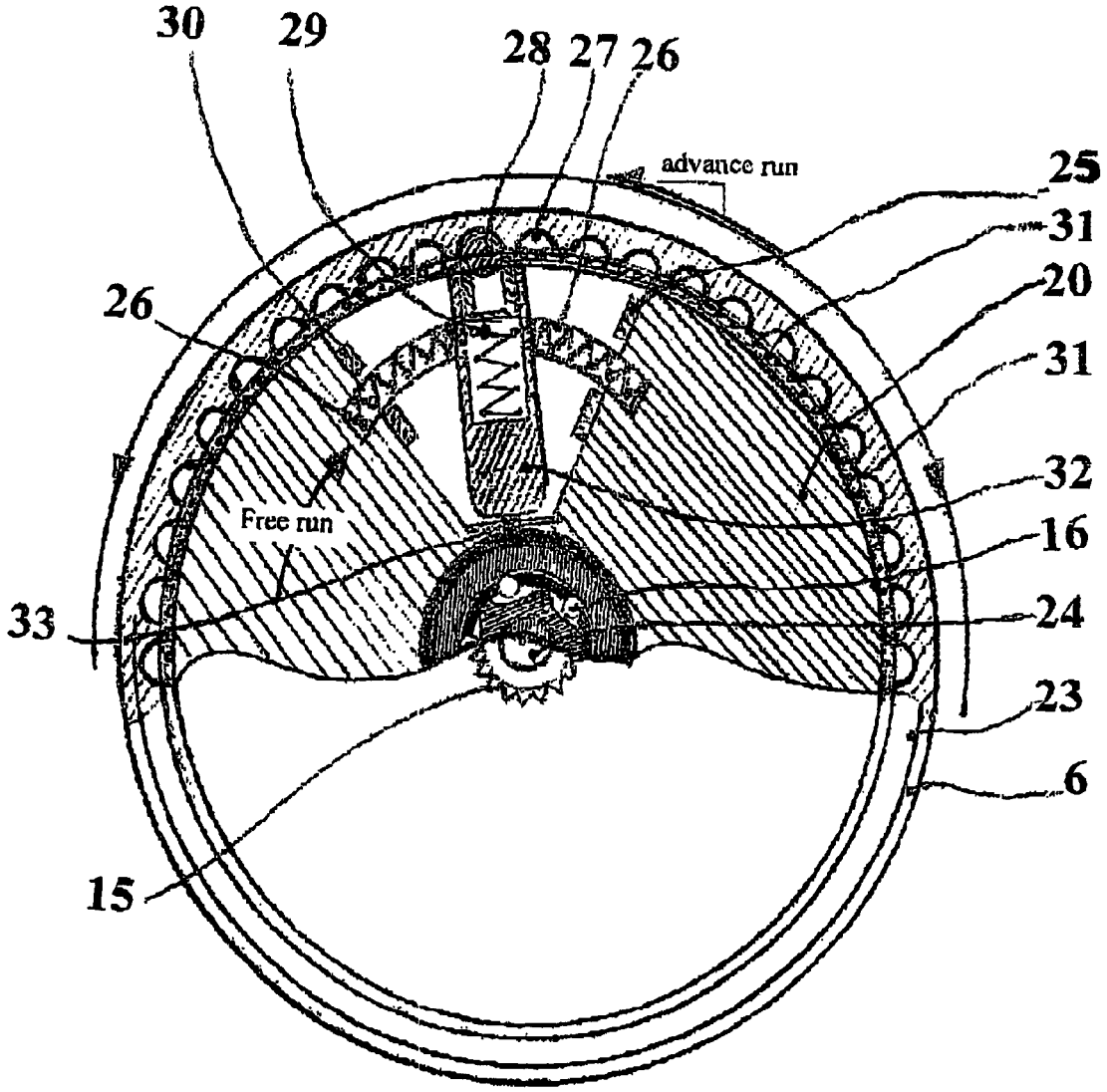
FIG. 2 is a diagram of a drive wheel is accordance with some embodiments.

Skate propulsion mechanisms are provided. In some embodiments, as shown in FIGS. 1 and 2, a user propels a skate using these mechanisms by applying a downward force on a shoe support plate 2 so that it moves relative to a base 13. An intermediate spatial distance is present as a pressure build-up path between the parts 2 and 13. On a load on part 2, up to contact with part 13, pressure is created which is converted by means of mechanical components of the part 13 into locomotion energy. The normal skate locomotion energy is increased by a free-wheel concept.

FIGS. 1 and 2 show the drive wheel 20 of the speed skate comprising a suspension shaft 24, a drive and free-wheel part 16, the outer wheel 23 and the balls 31 between the drive wheel 20 and the outer wheel 23, with running support 6.

The transfer element formed by 26, 28, 29, 32, which takes along the outer wheel 23 into the circumferential movement via the pitch ball mechanism 27 and 28, is located in the drive wheel 20.

As soon as energy is built up onto the drive wheel 20 via the spring 10 and the sprocket 17 as well as the sprocket 15, the spring 26 is pre-tensioned before the transfer of force to the wheel 23 and running surface 6 and the energy built-up is taken up and transferred gently. In the case of mechanical blocks due to some kind of incident, the pitch system formed by 27 and 28 serves as protection against the destruction of the mechanism in which the outer wheel 23 and running surface 6 is displaced over balls or plain bearing 31 on the drive wheel 20. During the movement of the skate on irregular surfaces 21, wheel 23 and running surface 6 absorbs impacts which act against the drive. Springs 26 damp the impact peaks acting on the drive from the outside and absorb negative energy.

The skate comprises the base parts 2 and 13. By pressure of the body weight of the user on the plate 2, the pressure build-up path 14 against compression spring 10 is overcome so that there is contact with the base part 13.

Pressure is built up via the spring 10 by the weight of the user and is transmitted by the rack 11 and the gear 18 via gears 17 and 15 onto the drive wheel 20 with ground contact 21 and is converted into a forward movement of the skate. The compression spring 10 is replaceable and can be matched to the body weight of the individual user.

The drive wheels 17 and 20 are designed in accordance with the free-wheel principle, which permits a transfer of force in the direction 34 which is utilized as free-wheel energy. By removing the load from the plate 2 by switching the user's weighted leg from the left to the right skate, the spring 10 is relaxed into the zero position via the spring 19 and the free-wheel 16. The same procedure as before takes place with the right skate and so on.

It is important that the traction of the skate can remain between the step changes. This advantage permits different gliding travel techniques as in competitive sport. The unchanging height of the plate 2 is ensured by energy stored in 9, 10, and 11.

The following reference numerals are used in the figures. 1—ball bearing; 2—shoe support base; 3—shoe; 4—movement wheel; 5—system holder; 6—running surface; 7—support column; 8—container for pressure build-up; 9—spring guidance; 10—pressure build-up spring; 11—rack for pressure transfer; 12—guide bolt; 13—undercarriage; 14—pressure build-up distance; 15—sprocket for drive wheel; 16—free-wheel for drive system 16 and 18; 17—sprocket for path distance transfer; 18—pressure energy store for movement energy; 19—system back transfer spring for a new start; 20—drive wheel; 21—rolling surface; 22—return or free-wheel; 23—outer portion of wheel 20; 24—suspension shaft at the undercarriage; 25—support buffer for forward running; 26—buffer springs for drive and external energy peaks; 27—hollow space for pitch balls; 28—pitch ball, which catches of the outer wheel; 29—compression spring for pitch ball; 30—support buffer for return energy; 31—bearing ball; 32—pivot lever with installed pitch; 33—catch of the pivot lever; and 34—direction of movement to drawing.

As can be seen, by applying a downward force on the skate to propel the user forward, various embodiments of the invention can reduce the lateral forces on the user's knee joints, and therefore reduce injury.

Although the invention has been described and illustrated in the foregoing illustrative embodiments, it is understood that the present disclosure has been made only by way of example, and that numerous changes in the details of implementation of the invention can be made without departing from the spirit and scope of the invention, which is only limited by the claims which follow. Features of the disclosed embodiments can be combined and rearranged in various ways.

What is claimed is:

1. A skate propulsion mechanism, comprising:

a base plate;

a drive wheel coupled to the base plate;

a shoe plate to which a user's foot can be coupled, which shoe plate can be moved relative to the base plate in response to movements in the user's foot; and a drive mechanism, coupling the shoe plate, the base plate, and the drive wheel, that propels the drive wheel when the user's foot is moved in a first direction and that permits the drivel wheel to operate in a free wheel mode when the user's foot is stationary, wherein the drive mechanism includes a pitch system for dampening impact forces on the drive wheel including a ball bearing, a plurality of hollow portions each arranged at different angles relative to a given radius of the drive wheel for engaging the ball bearing, a spring mechanism aligned along the given radius which presses the ball bearing into one of the plurality hollow portions at a given time, and at least one spring which resists angular movement of the spring mechanism away from the given radius.

2. The skate propulsion mechanism of claim 1, wherein the drive mechanism permits the drive wheel to operate in the free wheel mode when the user's foot moves in a second direction.

3. The skate propulsion mechanism of claim 2, wherein the second direction is an upward direction.

4. The skate propulsion mechanism of claim 1, wherein the first direction is a downward direction.

5. The skate propulsion mechanism of claim 1, wherein the drive mechanism includes a spring that isolates force applied to the shoe plate from force applied to the drive wheel.

6. The skate propulsion mechanism of claim 1, wherein the drive mechanism includes a rack and a gear that transfer linear motion to rotational motion.

7. The skate propulsion mechanism of claim 1, wherein the drive mechanism includes springs sized to account for the weight of a user.

8. A skate propulsion mechanism, comprising:

a base plate;

a drive wheel coupled to the base plate;

a shoe plate to which a user's foot can be coupled, which shoe plate can be moved relative to the base plate in response to movements in the user's foot; and a drive mechanism, coupling the shoe plate, the base plate, and the drive wheel, that propels the drive wheel when the user's foot is moved in a first direction and that permits the drivel wheel to operate in a free wheel mode when the user's foot is stationary, wherein the drive mechanism includes a spring that transfers force applied to the shoe plate from the user's foot to the drive wheel.

9. The skate propulsion mechanism of claim 8, wherein the drive mechanism includes springs sized to account for the weight of a user.

10. The skate propulsion mechanism of claim 8, wherein the first direction is a downward direction.

11. The skate propulsion mechanism of claim 8, wherein the drive mechanism permits the drive wheel to operate in the free wheel mode when the user's foot moves in a second direction.

12. The skate propulsion mechanism of claim 8, wherein the second direction is an upward direction.

13. The skate propulsion mechanism of claim 8, wherein the drive mechanism includes a rack and a gear that transfer linear motion to rotational motion.

* * * * *